US008223594B2

(12) United States Patent
Ihashi et al.

(10) Patent No.: US 8,223,594 B2
(45) Date of Patent: Jul. 17, 2012

(54) CHRONOGRAPH TIMEPIECE

(75) Inventors: Tomohiro Ihashi, Chiba (JP); Kenji Ogasawara, Chiba (JP); Kazuo Kato, Chiba (JP); Kazumi Sakumoto, Chiba (JP); Hiroshi Shimizu, Chiba (JP); Akira Takakura, Chiba (JP); Eriko Noguchi, Chiba (JP); Takanori Hasegawa, Chiba (JP); Keishi Honmura, Chiba (JP); Saburo Manaka, Chiba (JP); Kosuke Yamamoto, Chiba (JP)

(73) Assignee: Seiko Instruments Inc. (JP)

( * ) Notice: Subject to any disclaimer, the term of this patent is extended or adjusted under 35 U.S.C. 154(b) by 164 days.

(21) Appl. No.: 12/804,503

(22) Filed: Jul. 22, 2010

(65) Prior Publication Data

US 2011/0026371 A1 Feb. 3, 2011

(30) Foreign Application Priority Data

Jul. 23, 2009 (JP) ..... 2009-172511

(51) Int. Cl.

| | |
|---|---|
| ***G04B 19/04*** | (2006.01) |
| ***G04B 47/06*** | (2006.01) |
| ***G04F 5/00*** | (2006.01) |
| ***G04F 8/00*** | (2006.01) |

(52) U.S. Cl. ..... 368/80; 368/11; 368/110; 368/157

(58) Field of Classification Search ..... 368/11, 368/80, 110, 113, 155–157, 160; 318/696
See application file for complete search history.

(56) References Cited

U.S. PATENT DOCUMENTS

| | | | | |
|---|---|---|---|---|
| 4,321,520 | A * | 3/1982 | Ueda et al. | 318/696 |
| 4,321,521 | A * | 3/1982 | Ueda et al. | 318/696 |
| 5,289,452 | A | 2/1994 | Sakamoto et al. | 368/73 |
| 6,194,862 | B1 * | 2/2001 | Hara | 318/696 |
| 6,567,345 | B1 * | 5/2003 | Furukawa et al. | 368/80 |
| 6,724,692 | B1 * | 4/2004 | Akahane et al. | 368/204 |
| 2003/0137900 | A1 * | 7/2003 | Akahane et al. | 368/110 |

* cited by examiner

*Primary Examiner* — Vit Miska
(74) *Attorney, Agent, or Firm* — Adams & Wilks

(57) ABSTRACT

Disclosed is a chronograph timepiece in which it is possible to prevent the chronograph drive timing and the magnetic field detection timing from overlapping each other to unnecessarily effect driving with correction drive pulses. A processing unit controls drive circuits so as to drive a time indication motor and a chronograph indication motor with a predetermined timing based respectively on timekeeping information obtained and chronograph measurement information obtained, and effects control such that a magnetic field detecting unit detects a magnetic field with a predetermined timing; when the drive timing for the chronograph indication motor and the magnetic field detection timing for the magnetic field detecting unit overlap each other, the processing unit changes the magnetic field detection timing for the magnetic field detecting unit so that the drive timing for the chronograph indication motor and the magnetic field detection timing for the magnetic field detecting unit may not overlap each other.

6 Claims, 4 Drawing Sheets

CHRONOGRAPH TIMEPIECE

BACKGROUND OF THE INVENTION

1. Field of the Invention

The present invention relates to a chronograph timepiece having a time indicating function and a time measuring function.

2. Description of the Related Art

There has been developed a multi-function timepiece in which a plurality of drive motors are mounted in order to individually drive a plurality of indicator hands to endow it with a time indicating function for indicating time information as a basic function and, further, with a chronograph measuring function for performing time measurement, wherein there are mounted a magnetic field detecting unit for detecting an external magnetic field around the motors and a rotation detecting unit for detecting rotation of the motors (See, for example, Japanese Patent No. 3,019,324).

In the above multi-function timepiece, the rotation detecting unit and the magnetic field detecting unit are mounted in a timepiece time motor drive circuit; when non-rotation is detected or an external magnetic field is detected, control is effected such that the driving is performed with a drive pulse (correction drive pulse) of higher power effective value than the normal drive pulse for normal drive; a chronograph drive pulse at the time of normal driving of a chronograph motor drive circuit effects driving at an interval shorter than a 1-second cycle; thus, in many cases, driving is effected at high speed drive timing; it is common practice to use a drive pulse of high power effective value in order to eliminate the need for the mounting of the rotation detection unit and the magnetic field detecting unit.

Here, in a case in which chronograph measurement is started with an arbitrary timing by the user and in which the chronograph drive timing for driving the chronograph indication motor and the magnetic field detection timing for the timepiece time motor drive circuit overlap each other, an erroneous magnetic field detection is effected under the influence of magnetic field generation due to the chronograph drive pulse, causing driving to be effected unnecessarily by the correction drive pulse; further, there is generated a deviation in the drive timing for the time indication motor due to the starting of the magnetic field detection of the time indication motor after the chronograph drive pulse.

SUMMARY OF THE INVENTION

It is an aspect of the present invention to prevent a wasteful power consumption due to generation of an unnecessary correction drive pulse as a result of the chronograph drive timing and the magnetic field detection timing overlapping each other, and to prevent a deviation such as a delay in the time drive timing as a result of the magnetic field detection timing being simply delayed.

According to the present invention, there is provided a chronograph timepiece including: a time indication motor driving a time hand; a chronograph indication motor driving a chronograph hand; a magnetic field detecting unit detecting a magnetic field; a timekeeping unit effecting timekeeping; a chronograph measurement unit performing chronograph measurement; a motor drive unit which drives the chronograph indication motor and which normally drives the time indication motor with a normal drive pulse; and a control unit which controls the motor drive unit so as to drive the time indication motor and the chronograph indication motor based respectively on timekeeping information obtained by the timekeeping unit and chronograph measurement information obtained by the chronograph measurement unit and which effects control such that the magnetic field detecting unit detects the magnetic field with a predetermined timing, wherein, when a drive timing for the chronograph indication motor and a magnetic field detection timing for the magnetic field detecting unit overlap each other, the control unit effects control such that the drive timing for the chronograph indication motor and the magnetic field detection timing for the magnetic field detecting unit do not overlap each other.

In the chronograph timepiece of the present invention, it is possible to prevent wasteful power consumption due to generation of an unnecessary correction drive pulse as a result of the chronograph drive timing and the magnetic field detection timing overlapping each other.

Further, it is possible to prevent the chronograph drive timing and the magnetic field detection timing from overlapping each other without having to delay the time hand drive timing.

DETAILED DESCRIPTION OF THE PREFERRED EMBODIMENTS

Figure 1:
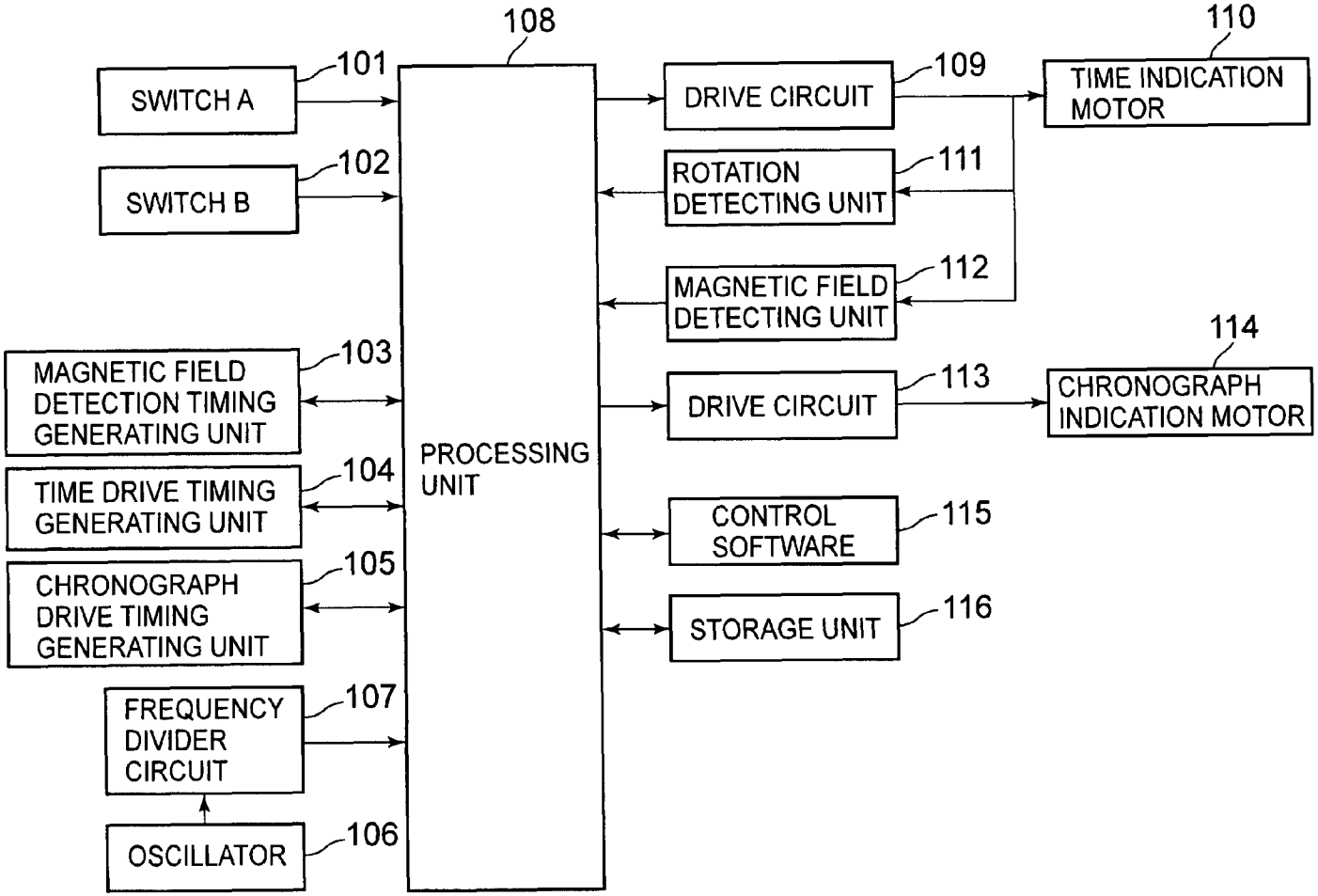
FIG. 1 is a block diagram showing a chronograph timepiece according to an embodiment of the present invention.

FIG. 1 is a block diagram showing a chronograph timepiece according to an embodiment of the present invention.

In FIG. 1, the chronograph timepiece includes a switch A 101 for performing starting of a chronograph function; a switch B 102 for performing stopping/resetting of the chronograph function; a magnetic field detection timing generating unit 103 for generating a magnetic field detection timing signal indicating an external magnetic field detection timing of the chronograph timepiece; a time drive timing generating unit 104 for generating a time hand drive timing signal indicating the drive timing for time hands (e.g., an hour hand, minute hand, and second hand) (not shown); a chronograph drive timing generating unit 105 for generating a chronograph hand drive timing signal indicating the drive timing for chronograph hands (e.g., a chronograph minute hand and chronograph second hand) (not shown); an oscillator 106 generating a signal of a predetermined frequency; a frequency divider circuit 107 effecting frequency division on the signal generated by the oscillator 106 to generate a timepiece signal serving as a timekeeping reference; and a processing unit 108 formed by a central processing unit (CPU) and performing various processing operations such as the control of motors 110 and 114 and of various electronic circuit elements constituting the chronograph timepiece.

Further, the chronograph timepiece includes: a drive circuit 109 rotating the time indication motor 110 with a drive pulse corresponding to a control signal from the processing unit 108; a time indication motor 110 consisting of a stepping motor and rotating the time hands (e.g., the hour hand, minute hand, and second hand); a rotation detecting unit 111 detecting whether or not the time indication motor 110 has been rotated; and a magnetic field detecting unit 112 detecting the presence of an external magnetic field in excess of a predetermined intensity by detecting an electric current caused to flow through a drive coil (not shown) of the time indication motor 110 by an external magnetic field when the time indication motor 110 is not being driven. The rotation detecting unit 111 and the magnetic field detecting unit 112 are of well-known constructions.

Further, the chronograph timepiece is equipped with: a drive circuit 113 rotating the chronograph indication motor 114 by a drive pulse corresponding to a control signal from the processing unit 108; the chronograph indication motor 114 consisting of a stepping motor and rotating the chronograph hands (e.g., a chronograph minute hand and chronograph second hand); a control software storage unit 115 storing software executed by the processing unit 108; and a storage unit 116 storing various kinds of information such as setting information, timekeeping information, or chronograph measurement information.

Here, the switch A 101 and the switch B 102 constitute an operating unit. The oscillator 106, the frequency divider circuit 107, and the processing unit 108 constitute the timekeeping unit for effecting timekeeping and the chronograph measuring unit for performing chronograph measurement. The drive circuit 109 constitutes a time indication motor driving unit. The drive circuit 113 constitutes a chronograph indication motor driving unit. The magnetic field detection timing generating unit 103, the time drive timing generating unit 104, the chronograph drive timing generating unit 105, and the processing unit 108 constitute a control unit. Further, the control software storage unit 115 and the storage unit 116 constitute a storage unit.

The operating unit is capable of performing the starting, stopping, and resetting of the chronograph measurement operation, and the control unit is capable of controlling each component so as to perform a processing corresponding to the operation by the operating unit.

Normally, the time indication motor drive unit drives the time indication motor 110 with a normal drive pulse P1; when the rotation detecting unit 111 detects non-rotation of the time indication motor 110, and when the magnetic field detecting unit detects an external magnetic field other than during the driving of the time indication motor, it can forcibly rotate the time indication motor 110 with a correction drive pulse P2 of larger power effective value than the normal drive pulse P1.

The chronograph indication motor drive unit drives the chronograph indication motor 114 with a drive pulse of high power effective value in order to take the rotation detecting unit out of use.

The control unit can control the time indication motor driving unit and chronograph indication motor driving unit so as to drive the time indication motor 110 and the chronograph indication motor 114 with a predetermined timing respectively based on the timekeeping information obtained by the time keeping unit and the chronograph measurement information obtained by the chronograph measuring unit, and effect control such that the magnetic field detecting unit 112 detects a magnetic field with a predetermined timing; further, when the drive timing for the chronograph indication motor 114 and the magnetic field detection timing for the magnetic field detecting unit 112 overlap each other, it can effect control such that the drive timing for the chronograph indication motor 114 and the magnetic field detection timing for the magnetic field detecting unit 112 do not overlap each other.

Further, when the drive timing for the chronograph indication motor 114 and the magnetic field detection timing for the magnetic field detecting unit 112 overlap each other, the control unit can change the magnetic field detection timing for the magnetic field detecting unit 112 so that the drive timing for the chronograph indication motor 114 and the magnetic field detection timing for the magnetic field detecting unit 112 may not overlap each other.

Further, when the first drive timing for the chronograph indication motor 114 and the magnetic field detection timing for the magnetic field detecting unit 112 overlap each other, the control unit can control the magnetic field detecting unit 112 so as not to effect the magnetic field detection; further, it can control the time indication motor drive unit such that the time indication motor 110 is driven, instead of by the normal drive pulse P1 corresponding to the magnetic field detection timing, by the correction drive pulse P2 of larger power effective value than the normal drive pulse P1.

Figure 2:
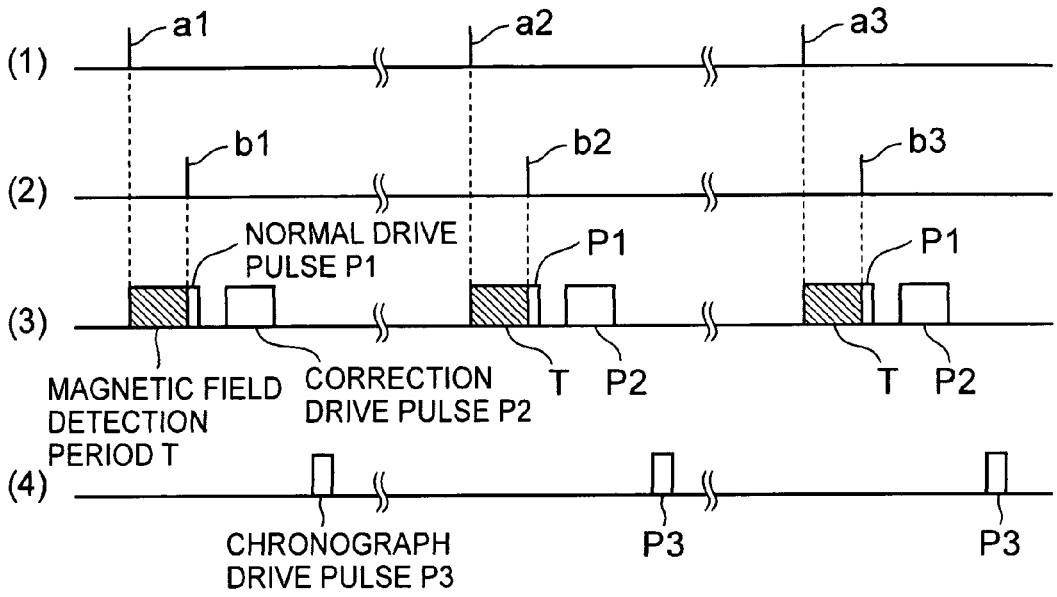
FIG. 2 is a timing chart for a chronograph timepiece according to an embodiment of the present invention.
Figure 3:
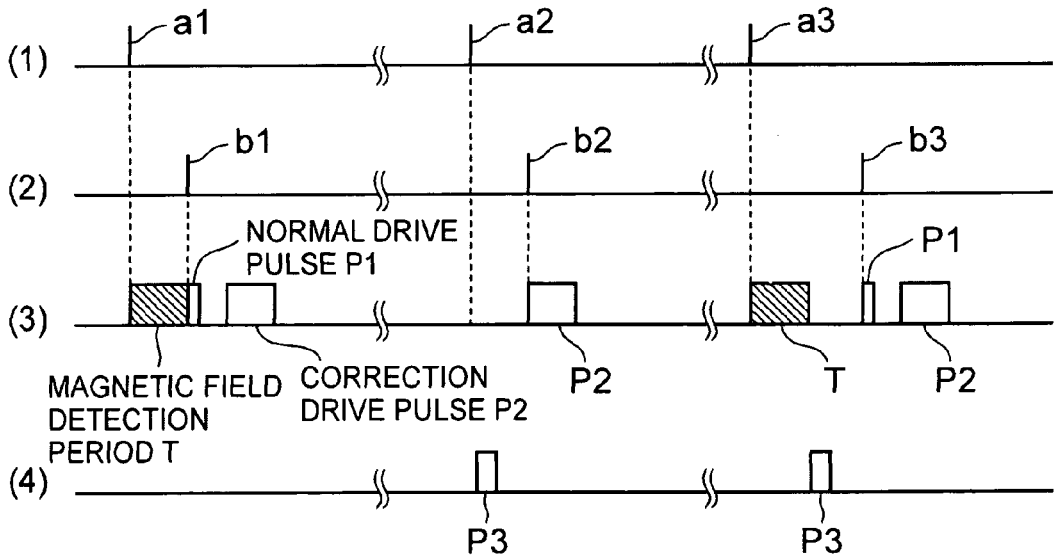
FIG. 3 is a timing chart for a chronograph timepiece according to an embodiment of the present invention.

FIGS. 2 and 3 are timing charts for the chronograph timepiece according to an embodiment of the present invention; FIG. 2 is a timing chart showing the normal hand movement state, and FIG. 3 is a timing chart showing the state in which the magnetic field detection timing and the drive timing for the chronograph indication motor 114 overlap each other.

During normal operation, the magnetic field detection timing generating unit 103 generates magnetic field detection timing signals a1, a2, a3, . . . (FIG. 2(1)) at a predetermined cycle, and the time drive timing generating unit 104 generates time drive timing signals b1, b2, b3, . . . after a magnetic field detection period T from the generation of the magnetic field detection timings a1, a2, a3, . . . (FIG. 2(2)).

First, the operation when the magnetic field detection timing T and a chronograph drive pulse P3 do not overlap each other will be described with reference to FIG. 2.

During normal operation, the processing unit 108 effects control such that the magnetic field detection is effected prior to the driving by the normal drive pulses P1. That is, the processing unit 108 controls the magnetic field detecting unit 112 so as to detect a magnetic field during a predetermined magnetic field detection period T in synchronism with the magnetic field detection timing signals a1, a2, a3, . . . (FIG. 2(3)). In response to the control of the processing unit 108 and during the magnetic field detection period T, the magnetic field detecting unit 112 detects whether or not an electric current generated in the drive coil of the time indication motor 110 by the external magnetic field exceeds a predetermined reference value with the time indication motor 110 not being driven.

When the magnetic field detecting unit 112 detects that an electric current in excess of the reference value is flowing through the time indication motor 110, the processing unit 108 judges that there exists an external magnetic field affecting the driving of the time indication motor 110. When the magnetic field detecting unit 112 detects that no electric current in excess of the reference value is flowing through the time indication motor 110, the processing unit 108 judges that there exists no external magnetic field affecting the driving of the time indication motor 110.

When it is judged that there exists no external magnetic field affecting the driving of the time indication motor 110 during the magnetic field detection period T, the processing unit 108 controls the drive circuit 109 so as to drive the time indication motor 110 by the normal drive pulses P1 in synchronism with the time drive timing signals b1, b2, b3, (FIG. 2(3)). In response to the control of the processing unit 108, the drive circuit 109 rotates the time indication motor 110 with the normal drive pulses P1. As a result, the current time is indicated by the time hands whenever necessary. When the rotation detecting unit 111 detects that the time indication motor has not been rotated by the above-mentioned driving, the processing unit 108 controls the drive circuit 109 so as to perform driving with the correction drive pulses P2 (FIG. 2(3)). In response to the control of the processing unit 108, the drive circuit 109 forcibly rotates the time indication motor 110 with the correction drive pulses P2. As a result, the time indication motor 110 rotates, and the time hands are properly moved.

When, during the magnetic field detection period T, it is judged that there exists an external magnetic field affecting the driving of the time indication motor 110, the processing unit 108 controls the drive circuit 109 so as to drive the time indication motor 110 with predetermined drive pulses (fixed drive pulses) of larger power effective value than the normal drive pulses P1 in synchronism with the time drive timing signals b1, b2, b3, . . . (FIG. 2(3)). In response to the control of the processing unit 108, the drive circuit 109 rotates the time indication motor 110 with the fixed drive pulses. As a result, it is possible to accurately move the time hands even when there exists an external magnetic field. The fixed drive pulses may be drive pulses of smaller power effective value than the correction drive pulses; it is also possible to use the correction drive pulses P2.

In the example of FIG. 2, when the chronograph measuring function is started by operating the switch A 101, the chronograph drive timing generating unit 105 generates a chronograph drive timing signal (not shown) at a predetermined cycle after the driving with the correction drive pulses P2 in response to the starting operation. In synchronism with the chronograph drive timing signal, the processing unit 108 controls the drive circuit 113 so as to drive the chronograph indication motor 114 with chronograph drive pulses P3 of large power effective value for eliminating the need for the detection of rotation of the chronograph hands and the detection of a magnetic field (FIG. 2(4)).

In response to the control of the processing unit 108, the drive circuit 113 rotates the chronograph indication motor 114 with the chronograph drive pulses P3. As a result, the chronograph hands are properly moved. When stopping operation is performed in the switch A 101, the processing unit 108 controls the drive circuit. 113 so as to stop the driving of the chronograph indication motor 114 in response thereto, whereby the chronograph measurement operation is stopped and the chronograph measurement results is indicated by the chronograph hands. When resetting operation is performed on the switch B 102, the processing unit 108 resets the chronograph measurement information stored in the storage unit 116 to zero, thereby zero-restoring the chronograph hands.

Next, the operation when the magnetic field detection period T and the chronograph drive pulses P3 overlap each other will be described with reference to FIG. 3.

When chronograph measurement operation is conducted and it is judged that the chronograph drive pulses P3 for the first driving overlap the magnetic field detection period T (the magnetic field detection period T synchronous with the magnetic field detection timing signal a2), the processing unit 108 controls the drive circuit 109 so as to perform driving immediately with the correction drive pulses P2 (the correction drive pulses P2 synchronous with the time drive timing signal b2) without effecting the magnetic field detection or the driving with the normal drive pulses P1. In synchronism with the drive timing of the normal drive pulses P1, the drive circuit 109 immediately drives the time indication motor 110 with the correction drive pulses P2, thereby moving the time hands. The drive circuit 113 drives the chronograph indication motor 114 with the chronograph drive pulses P3, thereby moving the chronograph hands.

As a result, in the case of the first time indication motor drive when the magnetic field detection period T and the chronograph drive pulses P3 overlap each other, the magnetic field detection is omitted, and the rotation drive is effected with the correction drive pulses P2, whereby, even if an external magnetic field exists, it is possible to reliably effect the rotation drive by using the correction drive pulses P2. As a result, it is possible to prevent a deviation in the drive timing for the time indication motor.

From the next drive cycle onward, the processing unit 108 effects control such that the magnetic field detection period T does not overlap the chronograph drive pulses P3. In the example of FIG. 3, the processing unit 108 changes the generation timing for the magnetic field detection timing signal a3 so that the magnetic field detection period T and the chronograph drive pulses P3 may not overlap each other. That is, the processing unit 108 shifts the magnetic field detection period T forwardly with respect to the chronograph drive pulses P3 so as to prevent overlapping.

In a new magnetic field detection section, the processing unit 108 causes the magnetic field detecting unit 112 to perform the detection of an external magnetic field as in the case of FIG. 2, with the time indication motor 110 not being driven; when it is judged that there exists no external magnetic field, driving is effected with the normal drive pulses P1; and when it is judged that there exists an external magnetic field, driving is effected with fixed drive pulses of larger power effective value than the normal drive pulses P1. As a result, from the second drive cycle onward in the case in which the magnetic field detection timing and the timing for the chronograph drive pulses P3 are allowed to overlap each other, it is possible to change the time drive pulses from the correction drive pulses P2 to appropriate normal drive pulses P1 by preventing overlapping, thereby preventing wasteful power consumption.

Figure 4:
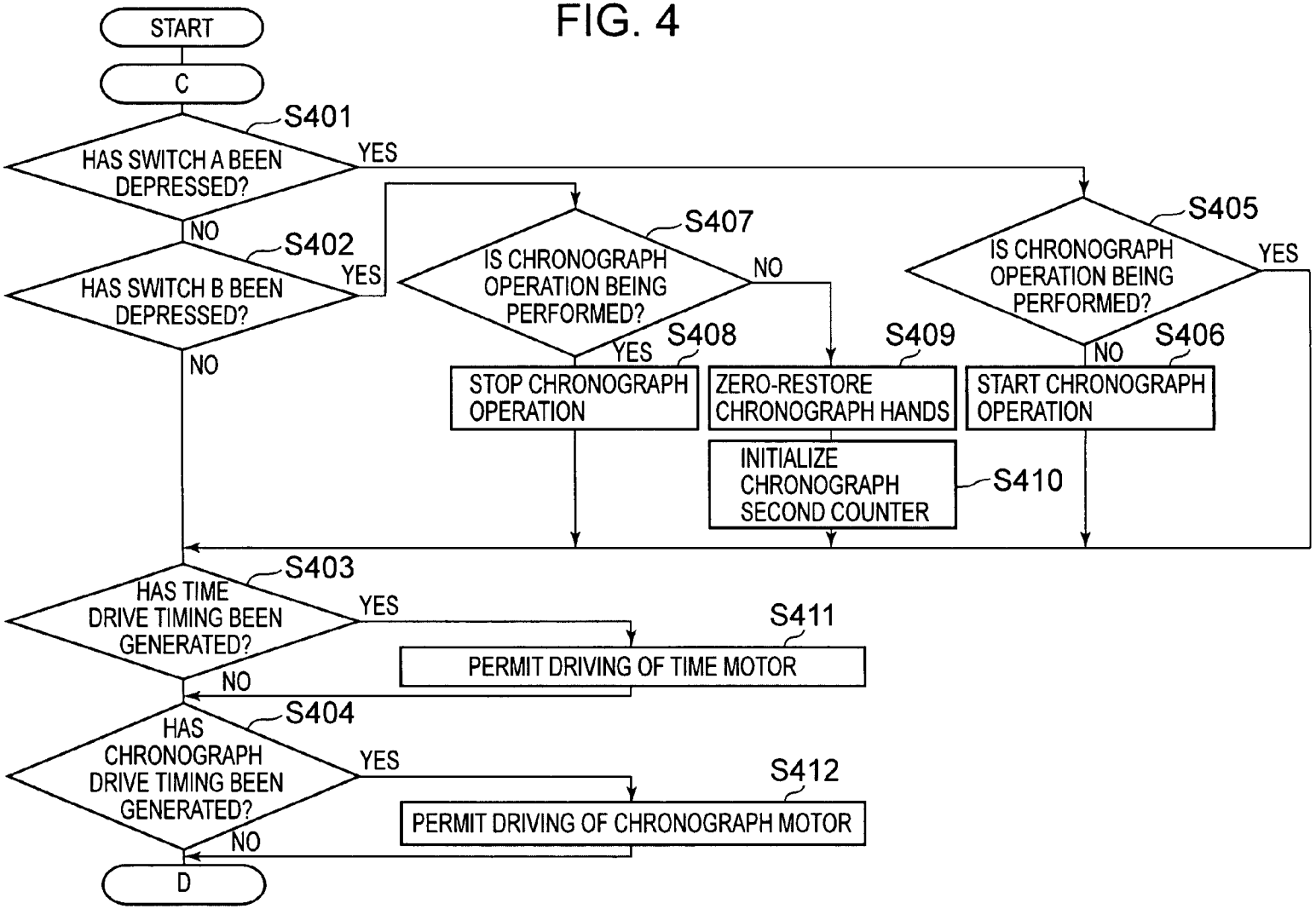
FIG. 4 is a flowchart for a chronograph timepiece according to an embodiment of the present invention.
Figure 5:
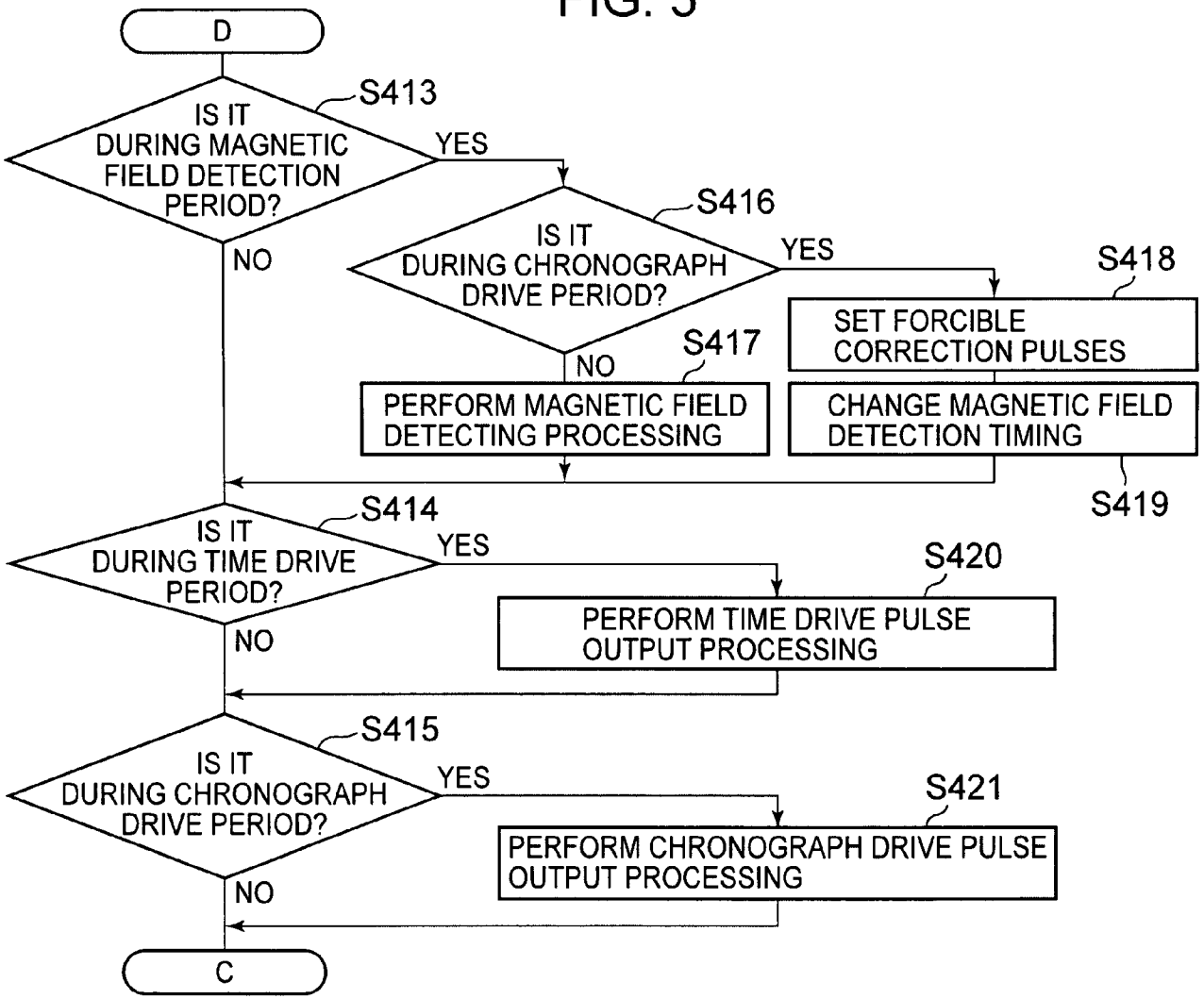
FIG. 5 is a flowchart for a chronograph timepiece according to an embodiment of the present invention.

FIGS. 4 and 5 are flowcharts for a chronograph timepiece according to an embodiment of the present invention, mainly illustrating a processing that is conducted through execution by the processing unit 108 of the control software stored in the control software storage unit 115.

In the following, the operation of a chronograph timepiece according to an embodiment of the present invention will be described with reference to FIGS. 4 and 5 while also referring to FIGS. 1 through 3.

When it is judged that the switch A 101 has been operated (step S401), the processing unit 108 advances to step S403 after starting chronograph measurement operation when no chronograph measurement operation is being currently conducted; and when it is judged that chronograph measurement operation is being currently conducted, it immediately advances to step S403 (steps S405 and S406).

When it is judged in step S401 that the switch A 101 has not been operated, and it is judged that the switch B 102 has been operated (step S402), the processing unit 108 zero-restores the chronograph hands when chronograph measurement operation is not being currently conducted, and a chronograph second counter (not shown) for measuring chronograph seconds is initialized, with the procedure advancing to step S403 (steps S407, S409, and S410). When it is judged in step S407 that chronograph measurement operation is being currently conducted, the processing unit 108 stops the chronograph measurement operation, and the procedure advances to step S403 (step S408).

Next, when it is judged that the time drive timing has been generated based on the time drive timing signal from the time drive timing generating unit 104 (step S403), the processing unit 108 controls the drive circuit 109 to drive the time indication motor 110, and the procedure advances to step S404 (step S411).

In the case in which it is judged in step S403 that the time drive timing has not been generated based on the time drive timing signal from the time drive timing generating unit 104, when it is judged that the chronograph drive timing has been generated based on the chronograph drive timing signal from the chronograph drive timing generating unit 105 (step S404), the processing unit 108 controls the drive circuit 113 to drive the chronograph indication motor 114, and the procedure advances to step S413 (step S412).

When it is judged in step S404 that no chronograph drive timing has been generated, the processing unit 108 makes a judgment as to whether or not it is during the magnetic field detection period T (step S413).

When it is judged in step S413 that it is during the magnetic field detection period T, the processing unit 108 controls the drive circuit 109 so as to forcibly effect rotation drive with the correction drive pulses P2 when it is during the chronograph drive period (steps S416 and S418); after control is effected so as to change the subsequent magnetic field detection timing of the magnetic field detection timing generating unit 103, the procedure advances to step S414 (step S419).

When it is judged in step S416 that it is not during the chronograph drive period, the processing unit 108 effects control so as to perform magnetic field detection by the magnetic field detecting unit 112, and then the procedure advances to step S414 (step S417).

When it is judged in step S414 that it is during the time drive period, the processing unit 108 controls the drive circuit 109 so as to rotate the time indication motor 110 with the normal drive pulses P1 for time drive in synchronism with the time drive timing signal from the time drive timing generating unit 104, and then the procedure advances to step S415 (step S420).

In the case in which it is judged in step S414 that it is not during the time drive period, when it is judged that it is during the chronograph drive period (step S415), the processing unit 108 controls the drive circuit 113 so as to drive the chronograph indication motor 114 in synchronism with the chronograph drive timing signal from the chronograph drive timing generating unit 105, and then the procedure returns to step S401 (step S421); when it is judged that it is not during the chronograph drive period, the procedure immediately returns to step S401.

As described above, in the chronograph timepiece of the above embodiment of the present invention, the processing unit 108 controls the drive circuits 109 and 113 so as to drive the time indication motor 110 and the chronograph indication motor 114 with a predetermined timing based respectively on the timekeeping information obtained and the chronograph measurement information obtained, and, at the same time, effects control such that the magnetic field detecting unit 112 detects a magnetic field with a predetermined timing; when the drive timing for the chronograph indication motor 114 and the magnetic field detection timing for the magnetic field detecting unit 112 overlap each other, it prevents the drive timing for the chronograph indication motor 114 and the magnetic field detection timing for the magnetic field detecting unit 112 from overlapping each other.

Further, when the drive timing for the chronograph indication motor 114 and the magnetic field detection timing for the magnetic field detecting unit 112 overlap each other, the processing unit 108 changes the magnetic field detection timing for the magnetic field detecting unit 112 so that the drive timing for the chronograph indication motor 114 and the magnetic field detection timing for the magnetic field detecting unit 112 may not overlap each other.

Thus, it is possible to prevent the chronograph drive timing and the magnetic field detection timing from overlapping each other to cause driving to be effected unnecessarily with the correction drive pulses.

Further, even when the chronograph drive pulses and the magnetic field detecting operation overlap each other at the time of chronograph function operation, it is possible to eliminate a deviation in the time indication motor drive timing.

Further, when the chronograph drive timing and the magnetic field detection timing overlap each other, the magnetic field detection timing is not simply delayed, so that there is no fear of the output timing for the time drive pulses thereafter being delayed.

Further, it is possible to mitigate an erroneous detection of a magnetic field due to the chronograph drive timing and a deviation in the time motor hand movement timing.

The present invention is applicable to a chronograph timepiece conducting timekeeping operation taking into account the influence of an external magnetic field.

What is claimed is:

1. A chronograph timepiece comprising: a time indication motor driving a time hand; a chronograph indication motor driving a chronograph hand; a magnetic field detecting unit detecting a magnetic field; a timekeeping unit effecting timekeeping; a chronograph measurement unit performing chronograph measurement; a motor drive unit which drives the chronograph indication motor and which normally drives the time indication motor with a normal drive pulse; and a control unit which controls the motor drive unit so as to drive the time indication motor and the chronograph indication motor with a predetermined timing, based respectively on timekeeping information obtained by the timekeeping unit and chronograph measurement information obtained by the chronograph measurement unit and which effects control such that the magnetic field detecting unit detects the magnetic field with a predetermined timing, wherein, when a drive timing for the chronograph indication motor and a magnetic field detection timing for the magnetic field detecting unit overlap each other, the control unit effects control such that the drive timing for the chronograph indication motor and the magnetic field detection timing for the magnetic field detecting unit do not overlap each other.

2. A chronograph timepiece according to claim 1, wherein, when the drive timing for the chronograph indication motor and the magnetic field detection timing for the magnetic field detecting unit overlap each other, the control unit changes the magnetic field detection timing for the magnetic field detecting unit so that the drive timing for the chronograph indication motor and the magnetic field detection timing for the magnetic field detecting unit may not overlap each other.

3. A chronograph timepiece according to claim 2, wherein the control unit changes the magnetic field detection timing to a timing with which the magnetic field detecting unit does not involve a change in the drive timing for the time indication motor.

4. A chronograph timepiece according to claim 1, wherein, when a first drive timing for the chronograph indication motor and the magnetic field detection timing for the magnetic field detecting unit overlap each other, the control unit controls the magnetic field detecting unit so as not to effect magnetic field detection, and controls the motor drive unit such that the time indication motor is driven, instead of by a normal drive pulse corresponding to the magnetic field detection timing, by a correction drive pulse of larger power effective value than the normal drive pulse.

5. A chronograph timepiece according to claim 2, wherein, when a first drive timing for the chronograph indication motor and the magnetic field detection timing for the magnetic field detecting unit overlap each other, the control unit controls the magnetic field detecting unit so as not to effect magnetic field detection, and controls the motor drive unit such that the time indication motor is driven, instead of by a normal drive pulse corresponding to the magnetic field detection timing, by a correction drive pulse of larger power effective value than the normal drive pulse.

6. A chronograph timepiece according to claim 3, wherein, when a first drive timing for the chronograph indication motor and the magnetic field detection timing for the magnetic field detecting unit overlap each other, the control unit controls the magnetic field detecting unit so as not to effect magnetic field detection, and controls the motor drive unit such that the time indication motor is driven, instead of by a normal drive pulse corresponding to the magnetic field detection timing, by a correction drive pulse of larger power effective value than the normal drive pulse.

* * * * *